US007043849B1

(12) United States Patent
Leger

(10) Patent No.: US 7,043,849 B1
(45) Date of Patent: May 16, 2006

(54) MULTIFUNCTION CALIPER INSTRUMENT FOR THE ARTS

(76) Inventor: Delmar Laurence Leger, 61389 Tombstone Dr., Montrose, CO (US) 81401

( * ) Notice: Subject to any disclaimer, the term of this patent is extended or adjusted under 35 U.S.C. 154(b) by 0 days.

(21) Appl. No.: 11/050,092

(22) Filed: Feb. 3, 2005

(51) Int. Cl.
*B43L 9/08* (2006.01)

(52) U.S. Cl. ..... 33/558.02; 33/558.2

(58) Field of Classification Search ..... 33/558.02, 33/558.04, 558.05, 558.2, 432, 434, 455, 33/465, 1 K, 18.3, 25.1, 23.01, 23.04, 23.06, 33/23.07, 23.08
See application file for complete search history.

(56) References Cited

U.S. PATENT DOCUMENTS

| | | | | | |
|---|---|---|---|---|---|
| 335,487 | A | * | 2/1886 | Taylor | 33/465 |
| 380,360 | A | * | 4/1888 | Spencer et al. | 33/43 |
| 967,267 | A | * | 8/1910 | Thompson | 33/558.02 |
| 1,079,110 | A | * | 11/1913 | Cole | 33/455 |
| 1,227,365 | A | * | 5/1917 | Bales | 33/558.2 |
| 1,296,660 | A | * | 3/1919 | Hayden | 7/135 |
| 1,321,924 | A | * | 11/1919 | Kuldell | 33/558.02 |
| 2,615,251 | A | * | 10/1952 | Edmunds | 33/25.1 |
| 2,645,021 | A | * | 7/1953 | Dierkes | 33/558.02 |
| 2,658,278 | A | * | 11/1953 | Debs | 33/473 |
| 2,865,106 | A | * | 12/1958 | Murdoch | 33/665 |
| 3,226,835 | A | * | 1/1966 | Kidjel | 33/558.02 |
| 3,293,761 | A | * | 12/1966 | Curry | 33/558.02 |
| 3,844,043 | A | * | 10/1974 | Gustafson | 33/455 |
| 3,858,324 | A | * | 1/1975 | Padowicz | 33/25.1 |
| 4,158,257 | A | * | 6/1979 | Kupperman et al. | 33/25.1 |
| 4,166,322 | A | | 9/1979 | Hirano | |
| 4,416,063 | A | | 11/1983 | Nestor et al. | |
| 4,453,318 | A | | 6/1984 | Hayes | |
| 4,768,953 | A | | 9/1988 | Nestor et al. | |
| 4,918,822 | A | | 4/1990 | Levitt | |
| 4,974,326 | A | * | 12/1990 | Nicyper | 33/25.2 |
| 5,154,004 | A | * | 10/1992 | Allen | 33/558.02 |
| 6,796,047 | B1 | * | 9/2004 | Arnott | 33/465 |
| 2003/0014876 | A1 | * | 1/2003 | Goldie | 33/558.02 |

FOREIGN PATENT DOCUMENTS

GB 2085810 A * 5/1982

* cited by examiner

*Primary Examiner*—R. Alexander Smith

(57) ABSTRACT

A multifunction instrument comprising four movable parts, including a first leg 12, an identical second leg 14, a pointer arm 16, and a connecting arm 18. Pointer arm 16 and connecting arm 18 are permanently but pivotally connected at pivot points 24A and 24B. Pivot points 20 A and B, 22 A and B, and 26 A and B are fastened by a removable fastener. The first leg 12 and second leg 14 have multiple holes drilled at intervals in the near end of each leg with a pivotal means of adjoining that allows for selecting various ratios. Legs 12 and 14 have a pivotal means of adjoining at pivot point 20A and 20B for determining angles and perspective. Legs 12 and 14 are calibrated and provide a straight edge, while flat surfaces provide printable space.

8 Claims, 4 Drawing Sheets

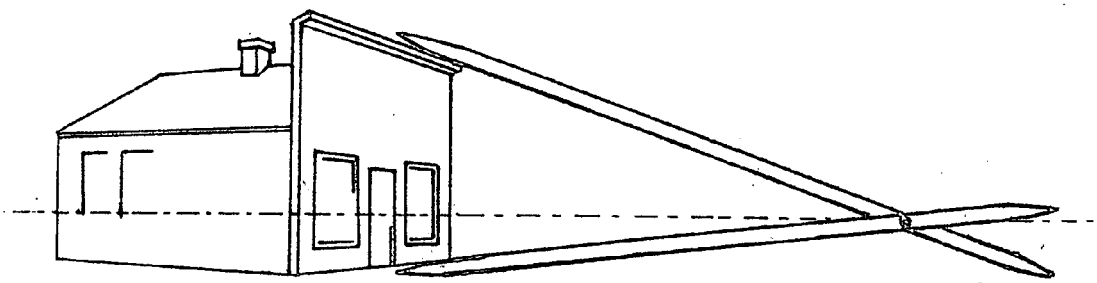
FIG 6
FIG 7
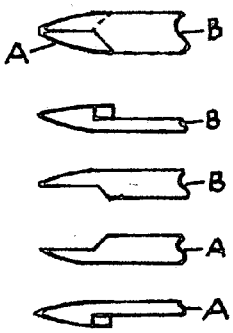
FIG 8
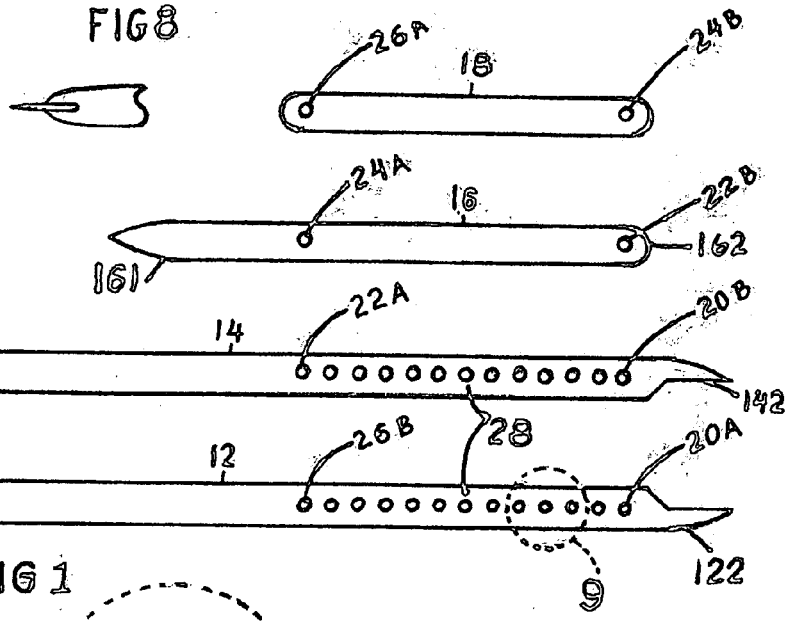
FIG 1
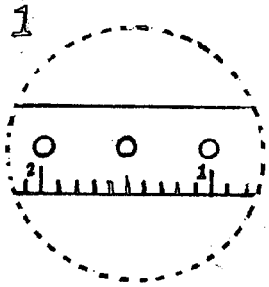
FIG 9

FIG 4
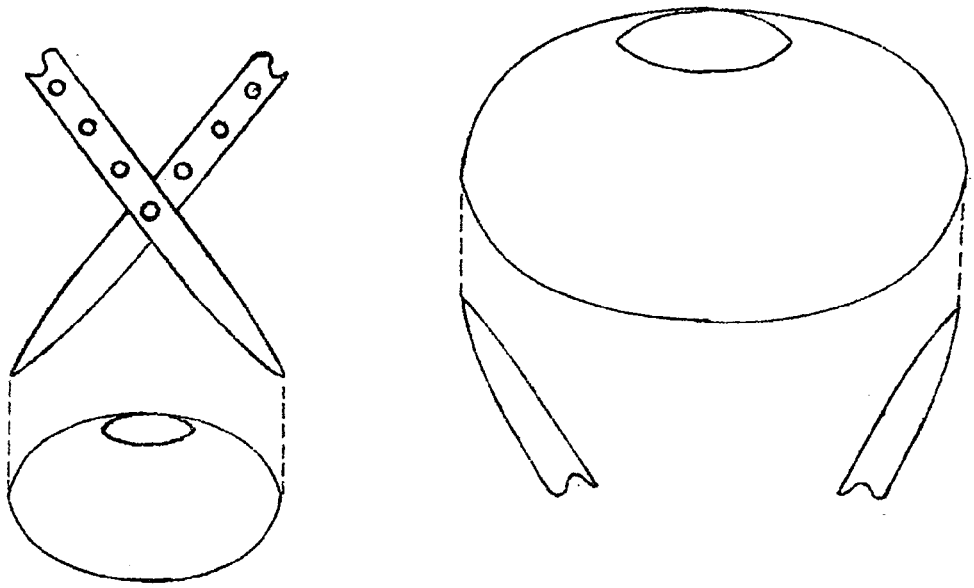
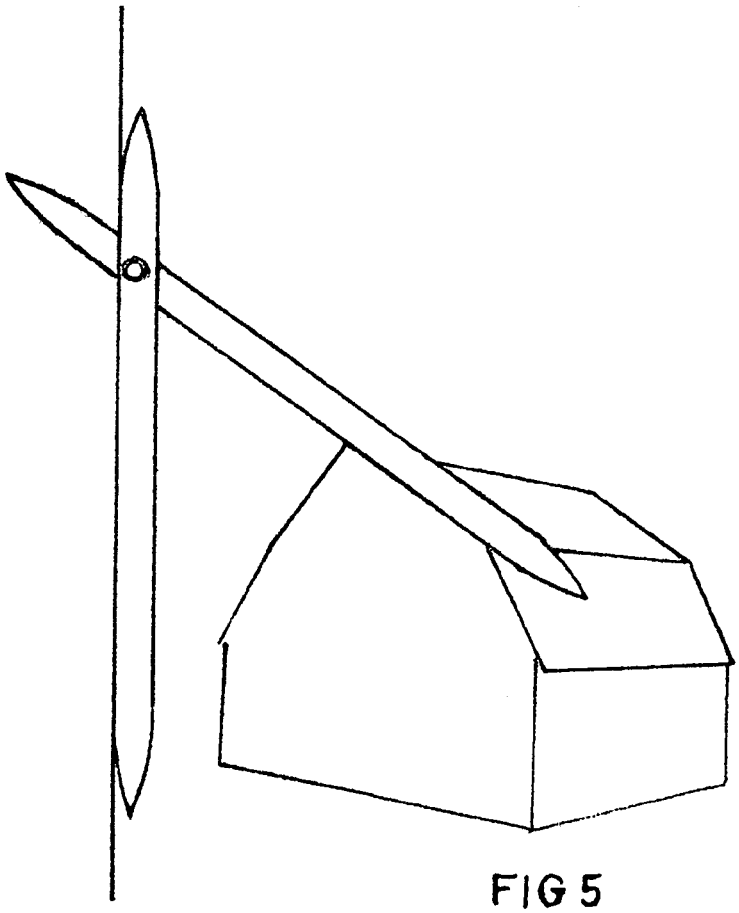
FIG 5

MULTIFUNCTION CALIPER INSTRUMENT FOR THE ARTS

BACKGROUND OF THE INVENTION

1. Field of the Invention

This invention relates to proportional or divider type instruments more particularly directed to the creative arts by identifying, verifying and overcoming problems in: 1. Composition, 2. Proportions, 3. Angles and 4. Perspective.

2. Prior Art

The relationship of objects in a composition determines its eye appeal and therefore its value. The same is true concerning the structure of an object in relation to its parts. The old masters of the Renaissance observed what seemed to be a universal constant of design in virtually everything they examined. It was often referred to as the "Golden Mean" and given the name Phi by the mathematician Mark Barr. By incorporating the constant Phi, along with correct proportions, angles and perspectives their artwork produced a well balanced and beautiful product. Architects have used these principals for centuries, as in the city of Athens, said by many to be the most beautiful city ever built by man.

Professionals and amateurs frequently utilize a variety of methods, guidelines and formulas in order to find and apply these four essential elements of creativity. Most are burdensome in that they are complicated, awkward, expensive, or not at hand. Because of these frustrations there is a need for an economical device that requires no mathematical calculations, is convenient, faster and simpler in application.

BACKGROUND OF INVENTION—OBJECTS AND ADVANTAGES

At this time there is no practical source for an economically priced, versatile, multifunctional product, that will work on either a two or three-dimensional object, as is being proposed herein.

The primary objective of this instrument is to provide a simple, handy, inexpensive and versatile tool to quickly determine and properly utilize these four key principles of creativity:

1. The constant known as Phi or Golden Mean, the ratio of 1 to 1.618.
2. Proportions of objects as they relate to one another.
3. Related angles in composition.
4. Establishing the correct perspective in relation to vanishing points and horizons.

Secondarily, the Multifunctional Abilities of this Instrument Provide for:

1. A handy straight edge and scaled ruler.
2. A surface for statements of interest, instructions in use, and/or artistic guidelines.
3. Different pointer tips for greater accuracy and durability.

Because this instrument is multifunctional it is much more likely to be kept close at hand, thus overcoming the common problem of limited use devices being not readily available.

This instrument will also be of benefit to those in the field of design engineering, fashion design and related fields. It will be a great teaching tool in mathematics and the basic sciences such as biology and astronomy. The constant of phi can be found in all things created, even in a spiral galaxy such as our own. Ministers will find this instrument helpful in demonstrating the commonality of all things thus supporting evidence of a single creator.

More specifically, this instrument fills the need for a simple, quick, portable and inexpensive device that can be used by teachers, students, artists, and designers to:

1. Pinpoint and incorporate the Golden Mean and its various divisions quickly, in any subject, with a minimum of effort.
2. Increase, decrease or confirm the size of an object in question, especially when reproducing by simply comparing the near end of legs 12 and 14 to the distal end.
3. Determine an angle of an object in relation to a vertical or horizontal line and for an angle between objects by utilizing the straight edge of Legs 12 and 14.
4. Aid in establishing or verifying perspectives in relation to vanishing points by utilizing the apex of legs 12 and 14.
5. Use as a readily available straight edge and scaled ruler.
6. Remind users of instructions on use or encouraging and inspirational statements.
7. Provide for Differing pointer tips depending on use intended.

The constant of phi, or the Golden Mean, works for any dimension. Therefore, this instrument can be designed to function for any size of application simply by varying the base number and multiplying accordingly. A base number of six inches is a convenient size, and will instantly locate the Golden Mean of any dimension between approximately 1.6" to 31.5" with a reasonable degree of accuracy. It works equally well for either two-dimensional pictures or three-dimensional objects.

Because of its simplicity of design it can be economically manufactured from a variety of materials and at an affordable price. Plastic, nylon, hardwood, or metal are some examples that would function well.

The instrument can be fabricated with tips as in FIG. 7 or 8 or left simply as pointed ends as shown in FIG. 2.

The instrument can be designed and manufactured as a Golden Mean indicator only, a ratio finder only, or as a multi-function tool such as described above.

1. As a Golden Mean Instrument:

When pivotally connected at pivot points 20A and 20B, 22A and 22B, 24A and 24B, 26A and 26B as in FIG. 2, the instrument serves as a Golden Mean locator. By pointing the distal tips of legs 12 and 14 to each outside edge of the area in question, pointer arm 16 will always point to the Golden Mean. Thus establishing that universal constant of design, the key to beauty, harmony and functionality in composition.

Art judges will find it a great help when evaluating art pieces and judging art shows. Teachers will be able to demonstrate and prove, visually, a mathematical concept that is otherwise difficult to convey. Science teachers and theologians well be able to make obvious a consistency of design and beauty in creation without resorting to complicated formulas. Because of its portability it would always be close at hand.

2. For Determining Ratios:

By removing pointer arm 16, pointer arm 18 and resetting the pivotal connection of legs 12 and 14 to the desired comparisons of sizes, the instrument can now be used to determine and/or prove a particular ratio between objects. This is of particular help to artists when there is a need to maintain the correct proportions of their subject, and for art judges when verifying proportions. FIG. 1, shows thirteen arbitrarily drilled holes spaced ½ inch apart in legs 12 and 14, thus providing a variety of ratios to choose from. Various means of a quick disconnect such as a snap rivet, or a small wing nut and bolt could be used as a means of fastening legs

12 and 14 together. Said means should be only firm enough to allow movement but tight enough to prevent slippage.

3. As an Angle Finder:

To determine angles, pivotally fasten pointer legs 12 and 14 at pivot point 20A and 20B. Place one pointer leg parallel to a vertical line, position the other pointer leg parallel to the object whose angle is to be determined, thereby matching the angle in question. The angle thus determined will be correct for any variation in size. The same results can be accomplished by placing one pointer leg parallel to a horizontal line if that would be more convenient. The same principle applies when determining the angle between two objects as well.

4. As a Perspective Guide:

By pivotally fastening pointer legs at the near end of 12 and 14 as above, the instrument can also be used as a handy aid in determining, verifying or establishing perspective. By placing the apex of pointer legs 12 and 14 at the horizon line or vanishing point, then place one leg along one edge of the subject the other leg along the opposite edge. The angles between the legs become a guide for the correct perspective.

5. As a Straight Edge:

The instrument can also serve as a handy quick reference straight edge and ruler by marking off a scale in either inches or centimeters on at least one surface of pointer leg 12 or 14. One pointer leg could be calibrated in inches and the other in centimeters.

6. Pertinent Statements:

At least one of the first leg, the second leg, the connecting arm, and the pivoting arm includes a surface having instructions on the various functions and uses of the instrument and/or statements of interest printed thereon.

7. Variety of Tips:

The instrument can be fabricated with a variety of tips depending on the intended use.

SUMMARY OF THE INVENTION

1. A multifunction instrument comprising substantially four movable parts of a suitable material, of a pre-selected length as determined by a function of phi, including a first leg 12, an identical second leg 14, a pointer arm 16, a connecting arm 18. Pointer arm 16 and connecting arm 18, are permanently but pivotally connected at pivot points 24A and 24B. Pivot points 20 A and B, pivot points 22 A and B, and pivot points 26 A and B are fastened by means of a removable fastener or quick disconnect.

2. Apparatus as set forth above utilizing first leg 12 and second leg 14 with arbitrarily selected multiple holes drilled at identical intervals in the near end of each leg with a pivotal means of adjoining that allows for selecting various ratios. By placing the two ends of the near end at one object and the two ends at the distal end at the other object it gives one a comparison between the two objects.

3. Apparatus as set forth above utilizing legs 12 and 14 with a pivotal means of adjoining at pivot point 20A and pivot point 20B allowing movement for determining angles and perspective. Angles are determined by aligning one leg to either a horizontal or vertical line and the other leg in line with the subject. With legs 12 and 14 pivotally joined at pivot points 20A and 20B, perspective can be determined by placing the apex of legs 12 and 14 at the Horizon line (eye level) or vanishing point, then place the subject contiguously between the legs.

4. Apparatus as set forth above providing a straight edge scaled in either inches or centimeters or both on legs 12 or 14 or both.

5. Apparatus as set forth above having instructions or statements of interest printed on otherwise blank surfaces of the parts. Examples, "Arm 16 always points to Phi", or "Cool colors recede, warm colors advance", or "The horizon is always at your eye level".

6. Apparatus as set forth above fabricated to have alternate tips as in FIG. 7 or with metal tips as in FIG. 8.

BRIEF DESCRIPTION OF THE DRAWINGS—FIGURES

FIG. 1 shows the four parts of the multifunction instrument including pointer legs 12, and 14, pointer arm 16, and connecting arm 18 presented herein.

FIG. 2 shows the multifunction instrument assembled at the four pivot points for use as a Golden Mean locator.

FIG. 3 demonstrates the application of the Golden Mean locator as an aid and guide in composition.

FIG. 4 demonstrates the multifunction instrument being used to determine Ratios.

FIG. 5 demonstrates the multifunction instrument being used to determine angles.

FIG. 6 demonstrates the instrument being used as a Perspective Guide.

FIG. 7 shows an alternate tip configuration.

FIG. 8 shows alternate steel tips.

FIG. 9 shows straight edge and scaled ruler.

DRAWINGS—REFERENCE NUMERALS

Figure 2:
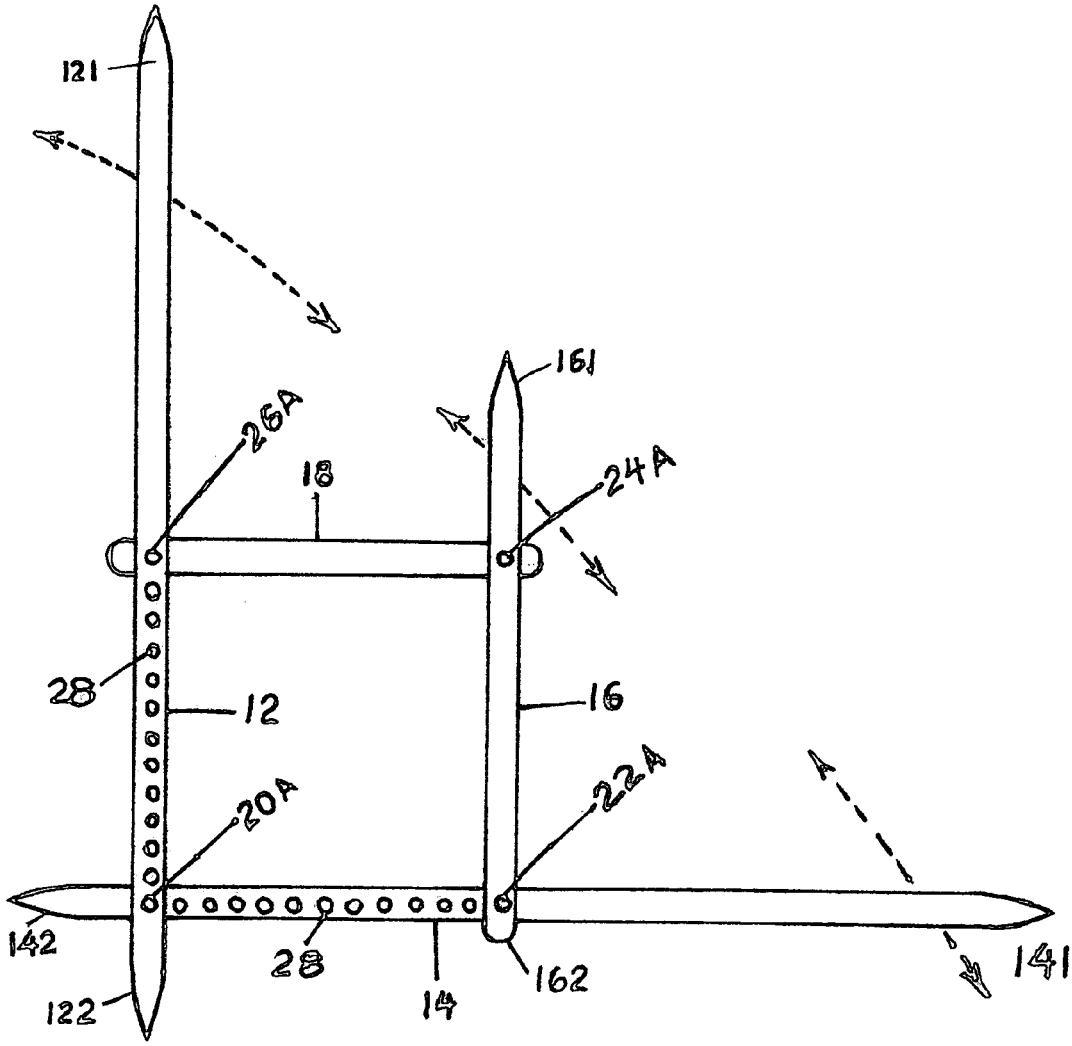

12, first leg
14, second leg
16, pointer arm
18, connecting arm
20A, pivot point for first leg
20B, pivot point for second leg
22A, pivot point for second leg and pointer arm
22B, pivot point for pointer arm and second leg
24A, pivot point for pointer arm and connecting arm
24B, pivot point for connecting arm and pointer arm
26A, pivot point for connecting arm and first leg
26B, pivot point for first leg and connecting arm
28, multiple pivot points in both first and second legs
121, distal tip of first leg
122, near end tip of first leg
141, distal tip of second leg
142, near end tip of second leg
161, distal tip of pointer arm
162, near end of pointer arm

DETAILED DESCRIPTION DRAWINGS

The Four Parts:

FIG. 1 shows the four parts of the instrument. The width and depth of each part is arbitrary. A base number is also arbitrary, however it will be used to determine the length of all four parts. Holes are drilled at predetermined points as illustrated to provide for pivotal fasteners and could be numbered for reference.

Legs 12 and 14

The length of the two legs 12 and 14 is established by multiplying 0.618 times an arbitrarily chosen base number resulting in the Golden Mean, or Phi, of the base number.

Twice the base number plus Phi equals the total length of legs 12 and 14 as measured from the pivot point 20A and 20B to the distal point of both legs. Added to this is an arbitrary additional length to allow for pointers at the near end of legs 12 and 14 so that the device can also function as a ratio gage.

Pointer Arm:

Also shown is the pointer or "phi" arm 16, the length of which is determined by multiplying the base number by 1.618 and measuring from pivot point 22B to pivot point 24A. Allow an additional length at the opposite end for assembly.

Connecting Arm 18

The connecting arm 18 is the length of the base number as measured from pivot point 24B to 26A plus an additional length added to each end to allow for assembly.

Assembly:

The instrument is assembled with any suitable fasteners that would allow pivoting and simple disconnect for all pivot points except where pivot points 24A and 24B join; this connection is permanent but pivotal. Where pivot points 12A and 12B join they are to be fastened with the ability of making those points snug, which could be a bolt and wing nut or similar fastener. The same type of fastener is used to establish pivot points for the ratio gage.

As a Golden Mean Locator:

FIG. 2 shows the instrument fully assembled and operational as a Golden Mean locator. The Golden Mean for that area between leg 12 and leg 14 is pointed to by pointer arm 16. As legs 12 and 14 are pivoted in or out pointer arm 16 will always point to the Golden Mean.

Figure 3:
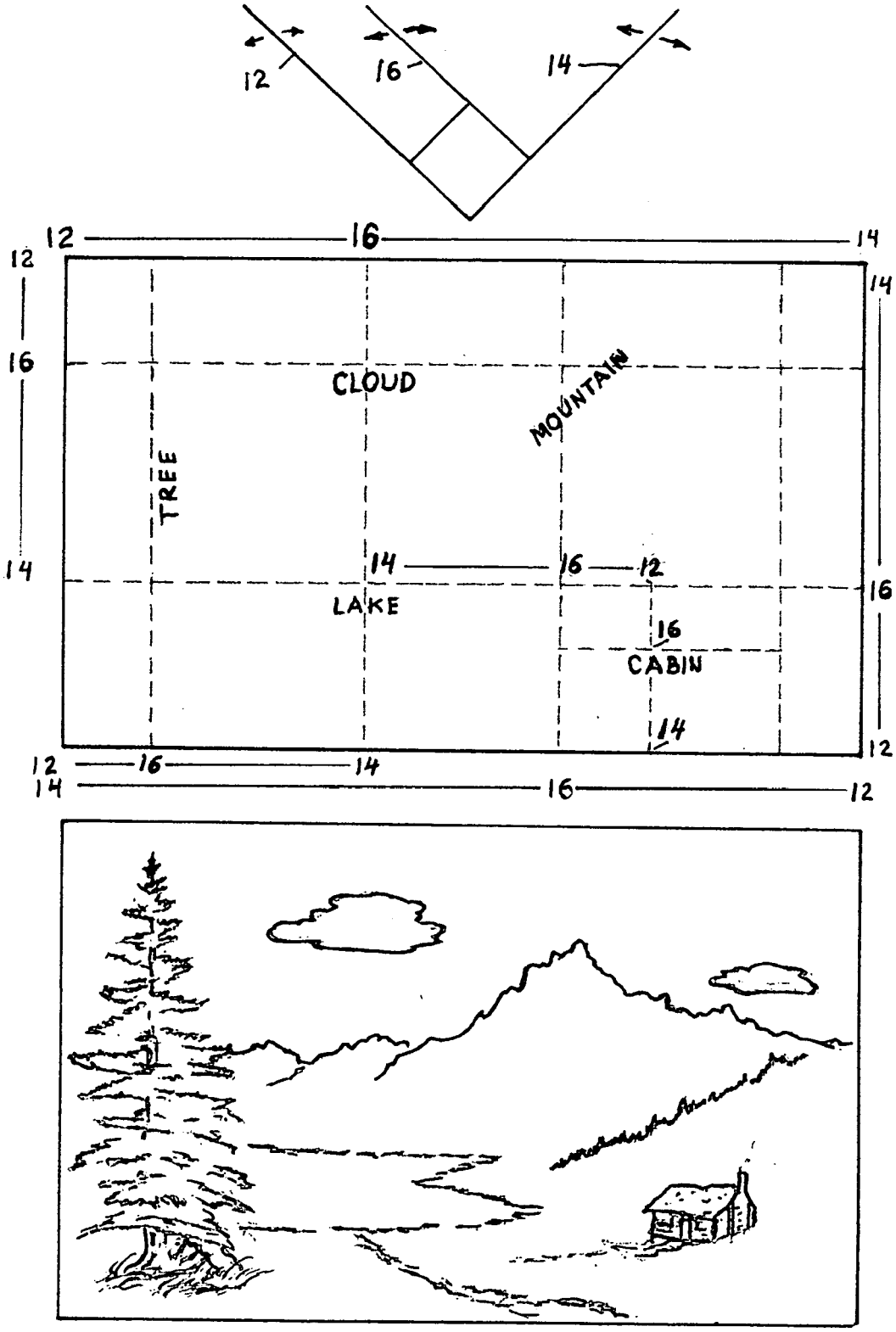

As an Aid in Composition:

FIG. 3 demonstrates the application of the invention as an aid in creating a pleasing two-dimensional composition by the proper use of the many divisions of the Golden Mean. Placement of all objects is determined by multiple divisions of the Golden Mean while giving respect to proper spacing and perspective.

Ratio Gage:

FIG. 4 shows the instrument assembled and being used as a Ratio Gage to determine or verify sizes and spacing.

Verifying Angles:

FIG. 5 demonstrates the instrument being used to determine or verify angles.

Perspective Guide:

FIG. 6 demonstrates instrument being used as an aid in establishing perspective.

Choice of Tips:

FIG. 7 shows the instrument made with alternate tips for a more accurate or durable tool. These could be made out of the same material as the rest of the unit.

Pin Point Accuracy:

FIG. 8 shows the instrument made with alternate tips of a more durable material such as metal and pointed for greater accuracy and durability.

Calibrated Straight Edge:

FIG. 9 shows Straight Edge and Scaled Ruler.

I claim:

1. A multifunction instrument comprising a first leg having a near end and an opposite distal end, each of the ends including a pointer, said first leg having a first leg to leg pivot point proximate to the near end and a first leg to arm pivot point located between the first leg to leg pivot point and the distal end, a second leg having a near end and an opposite distal end, each of the ends including a pointer, said second leg having a second leg to leg pivot point proximate to the near end and a second leg to arm pivot point located between the second leg to leg pivot point and the distal end, wherein a pivoting connection is formed by joining the first leg to leg pivot point and the second leg to leg pivot point together thereby allowing for pivotal movement of the first and second legs relative to each other, a pointer arm having a near end and an opposite distal end wherein the distal end includes a pointer, said pointer arm having an arm to leg pivot point located at the near end and an arm to arm pivot point located between the near end and the distal end, a connecting arm having two opposite ends wherein each includes a pivot point, wherein the arm to leg pivot point of the pointer arm is connected to one of the first and second leg to arm pivot points, and wherein one of the pivot points of the connecting arm is connected to the arm to arm pivot point of the pointer arm and the other of the pivot points of the connecting arm is connected to the other of the first and second leg to arm pivot points.

2. The multifunction instrument of claim 1, wherein each of the pivot points comprise holes and wherein the connections include connecting fasteners.

3. The multifunction instrument of claim 1, wherein said instrument is adjustable for allowing selection of various ratios, said instrument comprising:

the first leg including additional pivot points spaced between the first leg to leg pivot point and the first leg to arm pivot point, the second leg including additional pivot points spaced between the second leg to leg pivot point and second first leg to arm pivot point, wherein said arm to leg pivot point of the pointer arm my be relocated to one of said additional pivot points of said one of the first and second legs, wherein said other of the pivoting points of the connecting arm may be relocated to one of said additional pivot points of said other of the first and second legs, and/or wherein the pivoting connection of said first and second legs may be relocated along the additional pivot points.

4. The multifunction instrument of claim 1, comprising:

the first leg including additional pivot points spaced between the first leg to leg pivot point and the first leg to arm pivot point, the second leg including additional pivot points spaced between the second leg to leg pivot point and second first leg to arm pivot point, wherein the connecting arm and the pointer arm may be separated from the multifunction instrument and wherein the pivoting connection of said first and second legs may be relocated along the additional pivot points for allowing selection of various ratios and for forming a perspective guide.

5. The multifunction instrument of claim 1, wherein the first leg, the second leg, the connecting arm, and the pointer arm have lengths that are determined as a function of phi such that the pointer of the pointer arm will always point to the Golden Mean.

6. The multi function instrument of claim 1, wherein at least one of the first and second legs includes at least one straight edge having at least one scaled ruler.

7. The multifunction instrument of claim 1, wherein at least one of the first leg the second leg, the connecting arm, and the pivoting arm includes a surface having statements of interest printed thereon.

8. The multifunction instrument of claim 1, wherein at least one of the pointers comprise differing tips.

* * * * *